US009533235B2

(12) United States Patent
Chen

(10) Patent No.: US 9,533,235 B2
(45) Date of Patent: Jan. 3, 2017

(54) ACOUSTO-OPTICAL BABY TOY WITH A REMOTE CONTROL MONITORING FUNCTION

(71) Applicant: Way-Hong Chen, Taipei (TW)

(72) Inventor: Way-Hong Chen, Taipei (TW)

( * ) Notice: Subject to any disclaimer, the term of this patent is extended or adjusted under 35 U.S.C. 154(b) by 108 days.

(21) Appl. No.: 14/487,141

(22) Filed: Sep. 16, 2014

(65) Prior Publication Data

US 2016/0074764 A1 Mar. 17, 2016

(51) Int. Cl.
*A63H 33/00* (2006.01)

(52) U.S. Cl.
CPC ..... *A63H 33/006* (2013.01)

(58) Field of Classification Search
CPC .. A63H 33/006; G08B 21/245; G08B 21/0202
See application file for complete search history.

(56) References Cited

U.S. PATENT DOCUMENTS 5,013,276 A * 5/1991 Garfinkel ..... A63H 13/00 446/14
5,370,570 A * 12/1994 Harris ..... A63H 33/006 24/486
6,413,141 B1 * 7/2002 Putney ..... A63H 33/006 446/227
6,629,727 B2 * 10/2003 Asbach ..... B60N 2/2821 297/188.06
6,769,952 B1 * 8/2004 Drosendahl ..... A63H 33/006 446/227
2003/0064818 A1 * 4/2003 Drosendahl ..... A63H 33/006 472/118
2003/0153240 A1 * 8/2003 DeJule ..... A63H 33/006 446/227
2005/0014443 A1 * 1/2005 Bapst ..... A63H 33/006 446/227
2005/0148278 A1 * 7/2005 Drobinski ..... A63H 33/006 446/227
2006/0052172 A1 * 3/2006 Stephen ..... A63H 33/006 472/135
2007/0058039 A1 * 3/2007 Clark ..... A63H 33/006 348/143
2010/0060448 A1 * 3/2010 Larsen ..... A63H 33/006 340/539.15

(Continued)

*Primary Examiner* — Michael Dennis
*Assistant Examiner* — Urszula M Cegielnik
(74) *Attorney, Agent, or Firm* — Alan D. Kamrath; Kamrath IP Lawfirm, P.A.

(57) ABSTRACT

An acousto-optical baby toy includes a cantilever control unit, an acousto-optical unit connected with the cantilever control unit, and a support unit connected with the cantilever control unit. The acousto-optical baby toy further comprises a remote controller connected with the circuit board of the cantilever control unit in a wireless manner. Thus, the acousto-optical baby toy presents the sound and image messages of the baby cot in a wireless manner so that the parents can operate the acousto-optical baby toy in a remote control manner to watch the instant condition of the baby placed in the baby cot. In addition, the acousto-optical baby toy indicates the environmental messages, functions as a night lamp, has an interactive acousto-optical effect and provides a vibrating function, thereby facilitating the parents taking care of the baby in the baby cot.

10 Claims, 15 Drawing Sheets

(56) References Cited

U.S. PATENT DOCUMENTS

2011/0230115 A1* 9/2011 Wang ..... A63H 33/006
446/227
2012/0295510 A1* 11/2012 Boeckle ..... A63H 3/28
446/72

* cited by examiner

ACOUSTO-OPTICAL BABY TOY WITH A REMOTE CONTROL MONITORING FUNCTION

BACKGROUND OF THE INVENTION

1. Field of the Invention

The present invention relates to a baby toy for a baby cot and, more particularly, to an acousto-optical baby toy with a remote control monitoring function.

2. Description of the Related Art

A baby cot or playpen is used to place a baby so that the baby can stay or play in the baby cot or playpen safely. A conventional motorized rocking baby bed is started automatically in an acoustically controlled manner to provide an amusement effect to the baby. However, the conventional motorized baby bed is operated by acoustic messages and does not have a remote control monitoring function, so that when the parents leave the baby bed, they cannot exactly watch and understand the instant condition of the baby placed in the baby bed in a remote control monitoring manner, thereby causing inconvenience to the parents when taking care of the baby.

BRIEF SUMMARY OF THE INVENTION

In accordance with the present invention, there is provided a baby toy comprising a cantilever control unit, an acousto-optical unit connected with the cantilever control unit, and a support unit connected with the cantilever control unit. The cantilever control unit includes a lower arm having a surface provided with an external connecting hole, at least two protruding columns mounted on a bottom of the lower arm, a circuit board mounted in the lower arm, a plurality of operation buttons mounted on the lower arm and connected with the circuit board, an environment detector mounted on the lower arm, a sound receiver mounted in the lower arm, a plurality of functional lamps mounted on the lower arm, a side lamp shade mounted on the lower arm and corresponding to the functional lamps, a surveillance camera mounted on the lower arm, and a vibrator externally connected with the circuit board. The lower arm has a curved arcuate shape. The side lamp shade is made of a light permeable material. The acousto-optical unit includes an upper arm connected with an upper end of the lower arm of the cantilever control unit, a speaker mounted in the upper arm, a driver mounted in the upper arm, a lamp holder mounted in the upper arm, a plurality of projecting lamps mounted on the lamp holder, a projecting shade mounted on the upper arm and covering the projecting lamps, an outer annular gear mounted on the projecting shade, a rotation gear mounted on the lamp holder and meshing with the outer annular gear, and a hanging member having a connecting shaft extended through the upper arm and connected with the driver and the rotation gear. The upper arm has a curved arcuate shape. The rotation gear is driven by the driver. The hanging member is used for hanging a toy. The support unit includes a base located at the bottom of the lower arm, a limit plate connected with the base, two connecting blocks mounted on the base, and a recessed portion formed between the connecting blocks. The base is provided with at least two limit pieces. The limit plate is provided with two arcuate slots, and the protruding columns are extended into the arcuate slots of the limit plate. The limit plate has a periphery provided with at least two limit grooves mounted on the limit pieces of the base. The recessed portion is mounted on a baby cot to attach the acousto-optical baby toy to the baby cot.

In practice, the circuit board is electrically connected with the external connecting hole, the sound receiver, the functional lamps, the surveillance camera, the speaker and the driver. In addition, a memory unit is built in the circuit board to store musical files for the speaker or image files for the surveillance camera.

The acousto-optical baby toy further comprises a remote controller connected with the circuit board of the cantilever control unit in a wireless manner. The remote controller includes a controller body, a plurality of control buttons mounted on the controller body and having functions corresponding to that of the operation buttons of the cantilever control unit, a monitor mounted on the controller body, and a sound emitter mounted on the controller body.

According to the primary advantage of the present invention, the acousto-optical baby toy presents the sound and image messages of the baby cot in a wireless manner so that the parents can operate the acousto-optical baby toy in a remote control manner to watch the instant condition of the baby placed in the baby cot, thereby keeping the baby's safety.

According to another advantage of the present invention, the acousto-optical baby toy indicates the environmental messages, functions as a night lamp, has an interactive acousto-optical effect and provides a vibrating function, thereby enhancing the versatility of the acousto-optical baby toy, and thereby facilitating the parents taking care of the baby in the baby cot.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
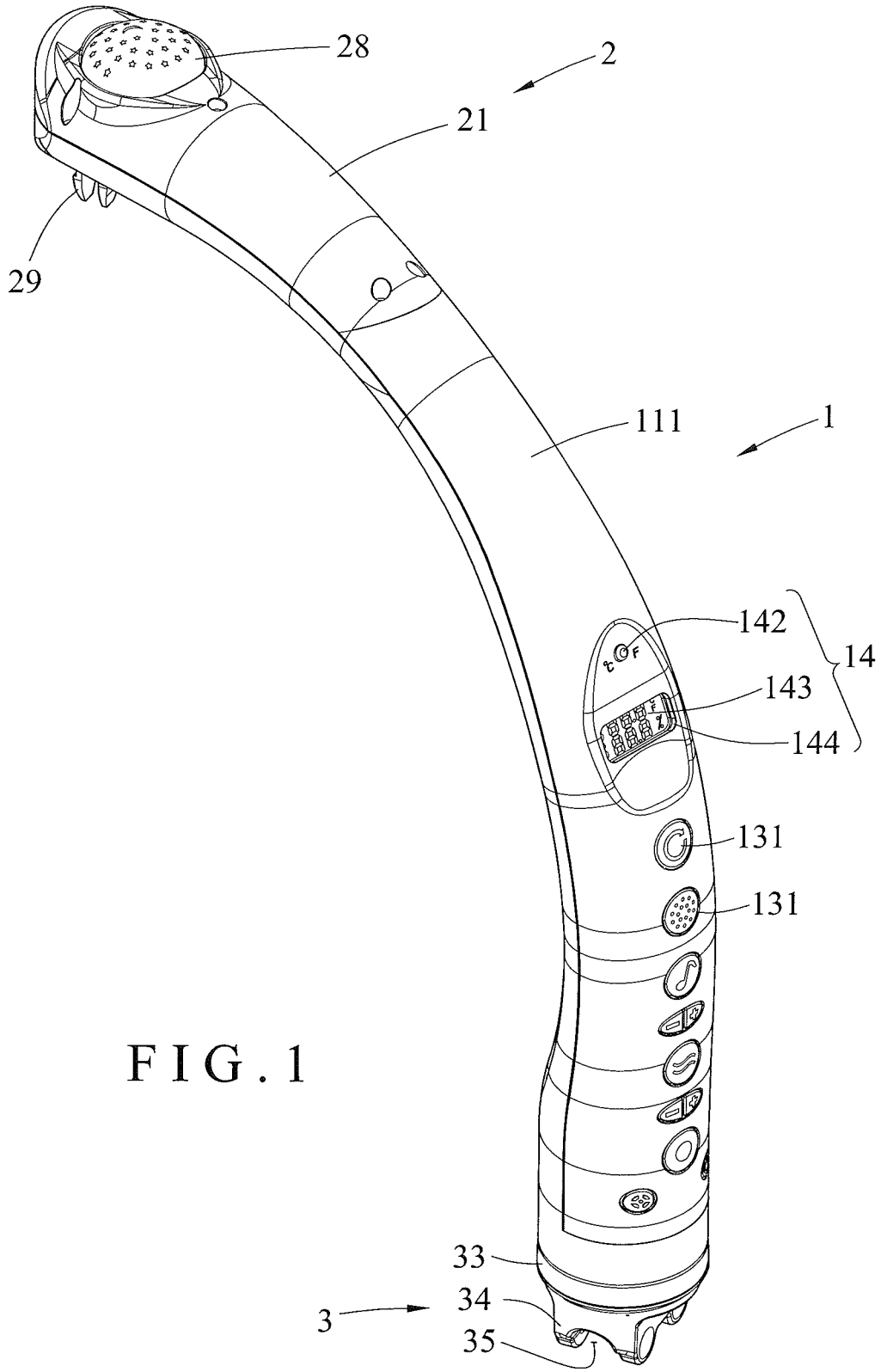
FIG. 1 is a perspective view of a baby toy in accordance with the preferred embodiment of the present invention.

Referring to the drawings and initially to FIGS. 1-9, an acousto-optical baby toy in accordance with the preferred embodiment of the present invention comprises a cantilever control unit 1, an acousto-optical unit 2 connected with the cantilever control unit 1, and a support unit 3 connected with the cantilever control unit 1.

The cantilever control unit 1 includes a lower arm 11 having a surface provided with an external connecting hole 15, at least two protruding columns 12 mounted on a bottom of the lower arm 11, a circuit board 13 mounted in the lower arm 11, a plurality of operation buttons 131 mounted on the lower arm 11 and connected with the circuit board 13, an environment detector 14 mounted on the lower arm 11, a sound receiver 16 mounted in the lower arm 11, a plurality of functional lamps 117 mounted on the lower arm 11, a side lamp shade 113 mounted on the lower arm 11 and corresponding to the functional lamps 117, a surveillance camera 18 mounted on the lower arm 11, and a vibrator 19 externally connected with the circuit board 13.

The lower arm 11 is hollow and has a curved arcuate shape. The lower arm 11 consists of an outer shell 111 and an inner shell 112 combined together. The lower arm 11 is formed with at least one receiving hole 161 aligning with the sound receiver 16 to facilitate the sound receiver 16 receiving the sound. The circuit board 13 is mounted on the inner shell 112. The operation buttons 131 are exposed from the lower arm 11 and have patterns or figures to indicate the functions of the operation buttons 131. The functional lamps 117 are located above the sound receiver 16 and are controlled to light or blink. The side lamp shade 113 is made of a light permeable material. The surveillance camera 18 is located above the functional lamps 117. The environment detector 14 includes an environment detection plate 141 mounted in the lower arm 11 to detect the temperature and humidity of the ambient environment, a switching button 142 protruded outward from the lower arm 11 and connected with the environment detection plate 141, and an indication portion 143 connected with the environment detection plate 141. The lower arm 11 is formed with an exposing hole 144 aligning with the indication portion 143 to expose the indication portion 143. The external connecting hole 15 is preferably used for a universal serial bus (U.S.B.). The sound receiver 16 is used for receiving and recording the sound. The vibrator 19 has an interior provided with a power supply member to provide the required electric power of the acousto-optical baby toy.

The acousto-optical unit 2 includes an upper arm 21 connected with an upper end of the lower arm 11 of the cantilever control unit 1, a speaker 22 mounted in the upper arm 21, a driver 23 mounted in the upper arm 21, a lamp holder 24 mounted in the upper arm 21, a plurality of projecting lamps 25 mounted on the lamp holder 24, a projecting shade 28 mounted on the upper arm 21 and covering the projecting lamps 25, an outer annular gear 27 mounted on the projecting shade 28, a rotation gear 26 mounted on the lamp holder 24 and meshing with the outer annular gear 27, and a hanging member 29 having a connecting shaft 291 extended through the upper arm 21 and connected with the driver 23 and the rotation gear 26.

The upper arm 21 is hollow and has a curved arcuate shape with a curvature the same as that of the lower arm 11 so that the upper arm 21 is connected with the lower arm 11 to have a smooth arcuate shape. The upper arm 21 is formed with at least one speaker hole 221 aligning with the speaker 22. The driver 23 is located at an upper of the upper arm 21 and includes a motor 231, a drive gear 232 connected with the motor 231, and a driven gear 233 meshing with the drive gear 232. The driver 23 is used to drive and rotate the projecting shade 28 and the hanging member 29. The lamp holder 24 is located above the driver 23. In the preferred embodiment of the present invention, the acousto-optical unit 2 includes two projecting lamps 25. The rotation gear 26 is driven by the driver 23. The outer annular gear 27 is formed on a bottom of the projecting shade 28. The projecting shade 28 has a surface provided with a plurality of holes to allow passage of light beams of the projecting lamps 25. The hanging member 29 is used for hanging an item, such as a toy and the like. The connecting shaft 291 is connected with the driven gear 233.

The support unit 3 includes a base 33 located at the bottom of the lower arm 11, a limit plate 31 connected with the base 33, two connecting blocks 34 mounted on the base 33, and a recessed portion 35 formed between the connecting blocks 34.

Figure 6:
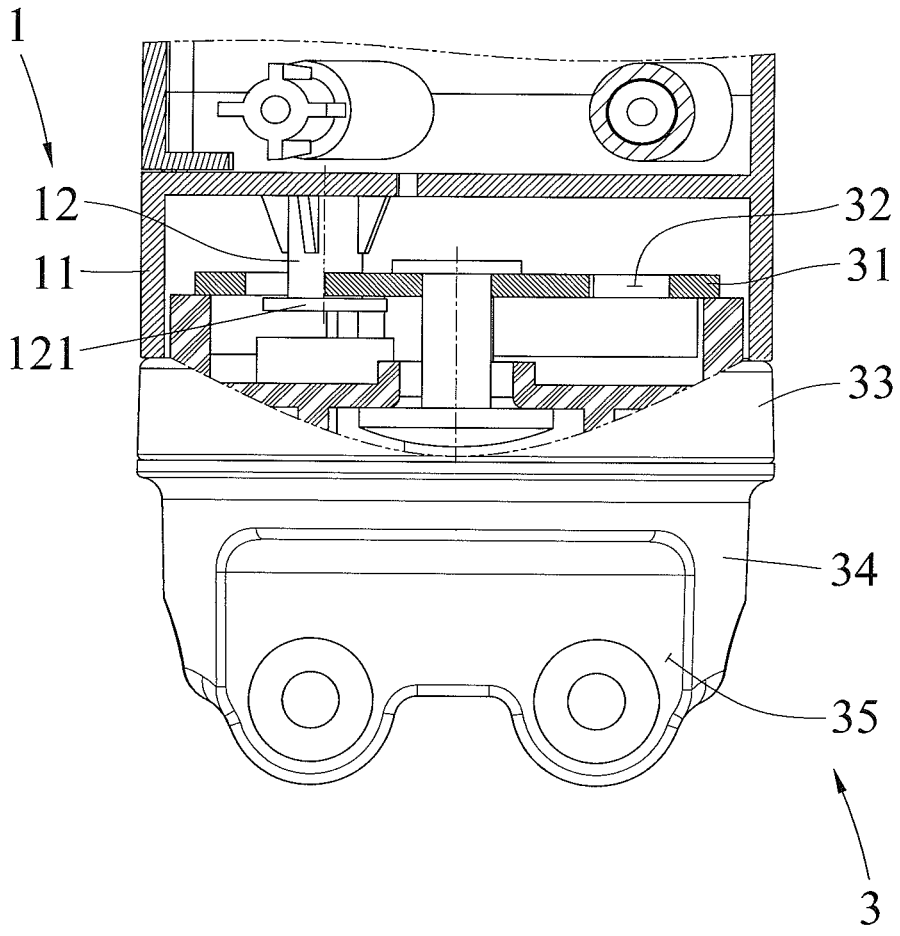
FIG. 6 is a cross-sectional assembly view of the baby toy as shown in FIG. 5.

The base 33 is provided with at least two limit pieces 331. The limit plate 31 is provided with two arcuate slots 32, and the protruding columns 12 are extended into the arcuate slots 32 of the limit plate 31 to limit the rotation angle of the cantilever control unit 1 relative to the support unit 3. The cantilever control unit 1 further includes two fasteners 121 connected with the protruding columns 12 respectively and abutting a bottom of the limit plate 31 as shown in FIG. 6 to limit the protruding columns 12 in the arcuate slots 32 of the limit plate 31. The limit plate 31 has a periphery provided with at least two limit grooves 311 mounted on the limit pieces 331 of the base 33. The connecting blocks 34 protrude from a bottom of the base 33. The recessed portion 35 is mounted on a baby cot to attach the acousto-optical baby toy to the baby cot.

In practice, the circuit board 13 is electrically connected with the external connecting hole 15, the sound receiver 16, the functional lamps 117, the surveillance camera 18, the speaker 22 and the driver 23, and the operation buttons 131 are pressed to operate the parts connected with the circuit board 13. In addition, a memory unit (not shown) is built in the circuit board 13 to store musical files for the speaker 22 or image files for the surveillance camera 18.

Figure 7:
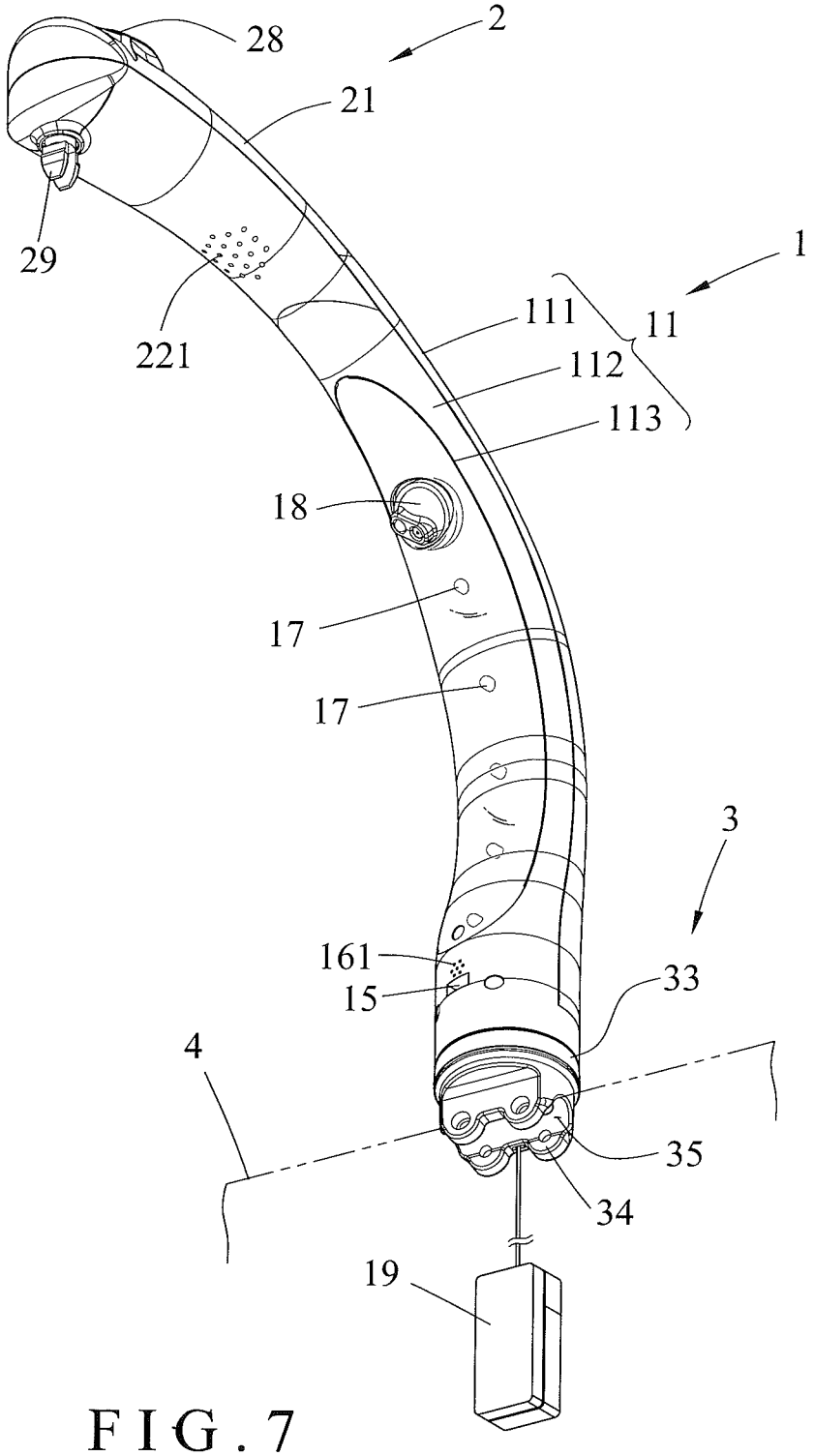
FIG. 7 is another perspective view of the baby toy as shown in FIG. 1.

In assembly, the recessed portion 35 of the support unit 3 is mounted on a fence 4 of the baby cot as shown in FIG. 7. Then, the connecting blocks 34 are locked by locking members so that the connecting blocks 34 are connected with the fence 4 to attach the acousto-optical baby toy to the baby cot.

In operation, the environment detector 14 of the cantilever control unit 1 can normally detects and indicates information of the temperature and humidity of the ambient environment. When in use, the environment detection plate 141 detects the temperature and humidity of the ambient environment, and the indication portion 143 indicates the information of the temperature and humidity. In addition, the user presses the switching button 142 to switch the indication portion 143 to indicate the temperature or humidity. Thus, the user can adjust the temperature and humidity according to the requirement.

Figure 8:
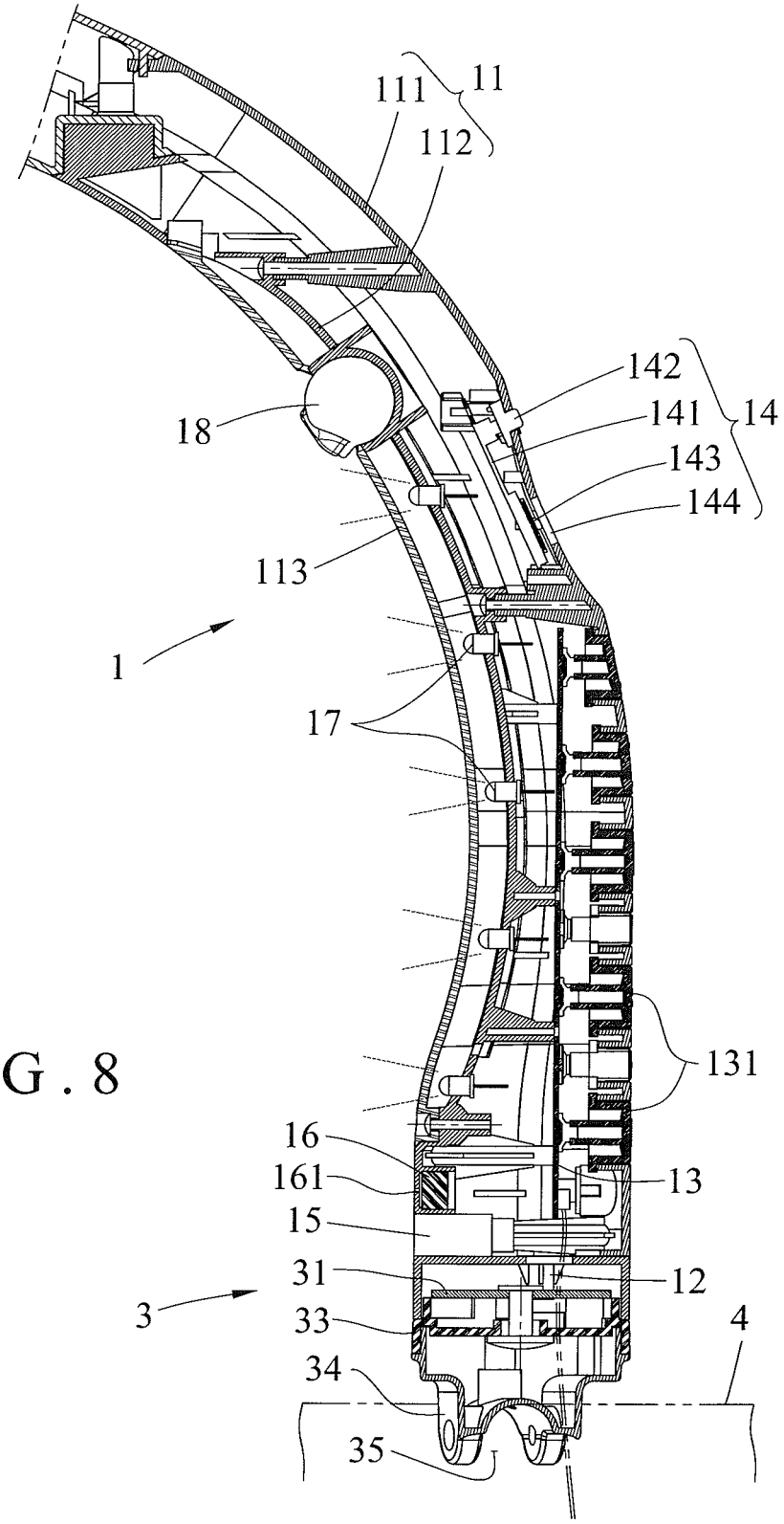
FIG. 8 is a partially cross-sectional operational view of the baby toy as shown in FIG. 7.

Alternatively, the functional lamps 117 are started by the operation buttons 131 of the circuit board 13 to provide a lighting function at the night as shown in FIG. 8. When the functional lamps 117 light, the side lamp shade 113 decreases the optical intensity of the functional lamps 117.

Figure 9:
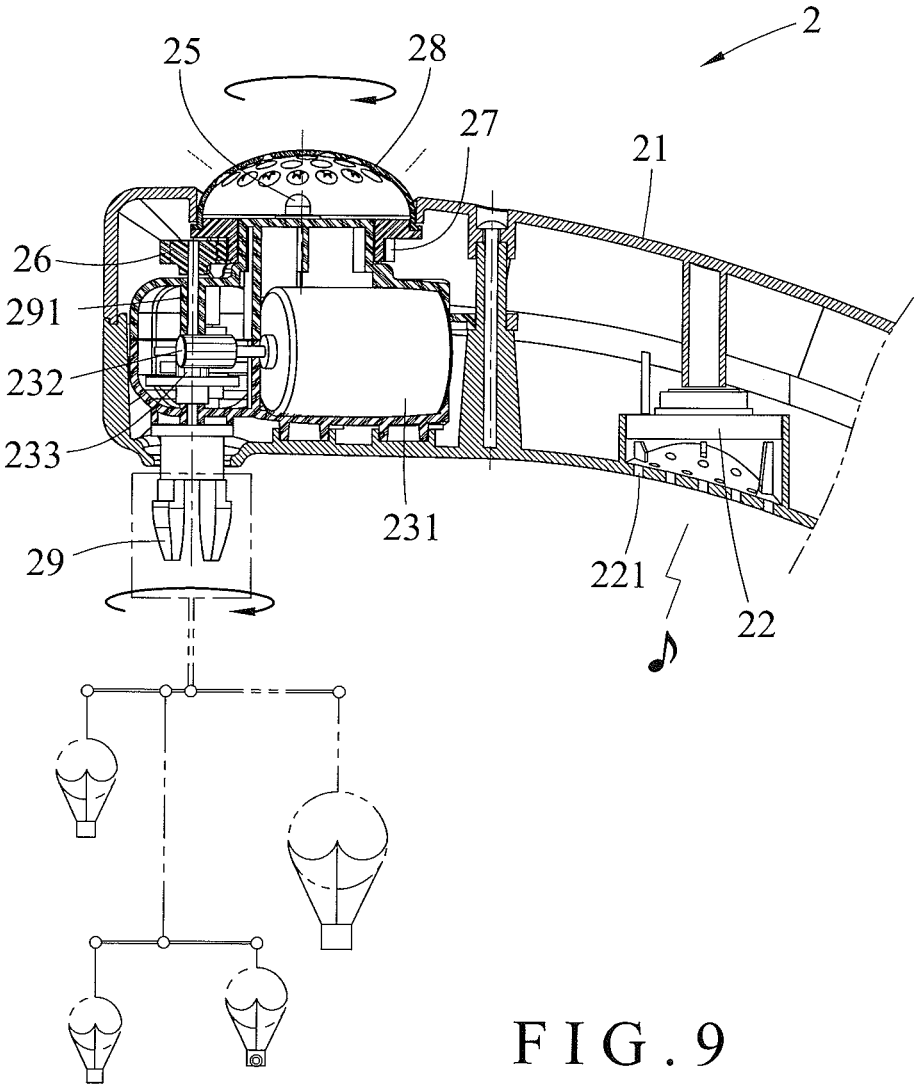
FIG. 9 is a partially cross-sectional operational view of the baby toy as shown in FIG. 7.

Alternatively, referring to FIG. 9 with reference to FIGS. 1-8, the speaker 22 is started by the operation buttons 131 of the circuit board 13 to play the musical files stored in the memory unit of the circuit board 13. In addition, the external connecting hole 15 is externally connected to an MP3 or a USB flash drive so that the speaker 22 can also play the musical files stored in the MP3 or USB flash drive. In addition, the motor 231 drives and rotates the drive gear 232 which rotates the driven gear 233 which rotates the connecting shaft 291 which rotates the hanging member 29 and the rotation gear 26. The rotation gear 26 rotates the outer annular gear 27 which rotates the projecting shade 28. The light beams of the projecting lamps 25 pass through the holes of the projecting shade 28 and are projected onto the ceiling, while the projecting shade 28 is rotated to vary the lighting effect. Thus, the functional lamps 117, the projecting lamps 25 and the speaker 22 cooperate to provide an interactive acousto-optical effect. At this time, the sound volume is controlled by the operation buttons 131.

Figure 2:
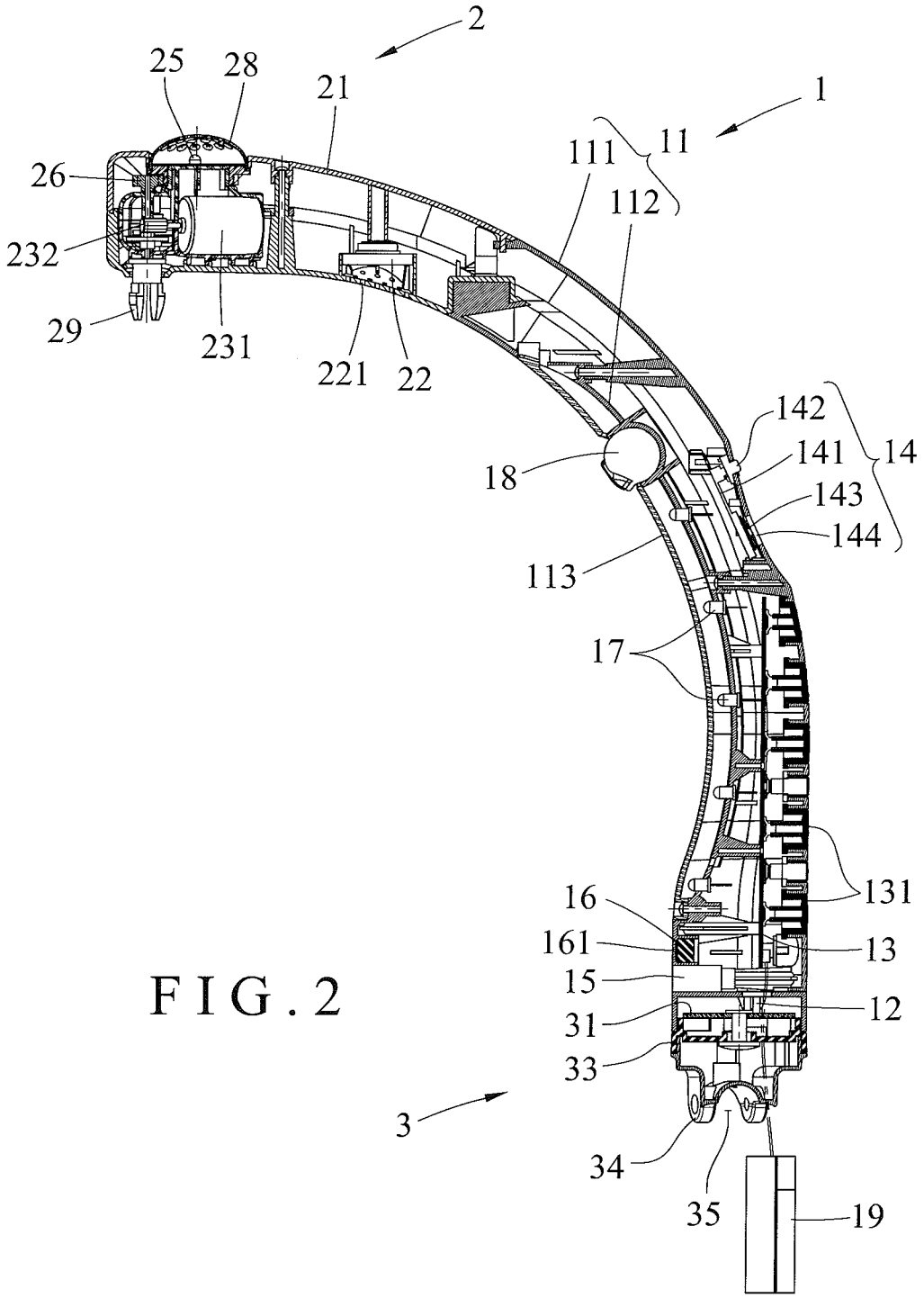
FIG. 2 is a cross-sectional view of the baby toy as shown in FIG. 1.
Figure 3:
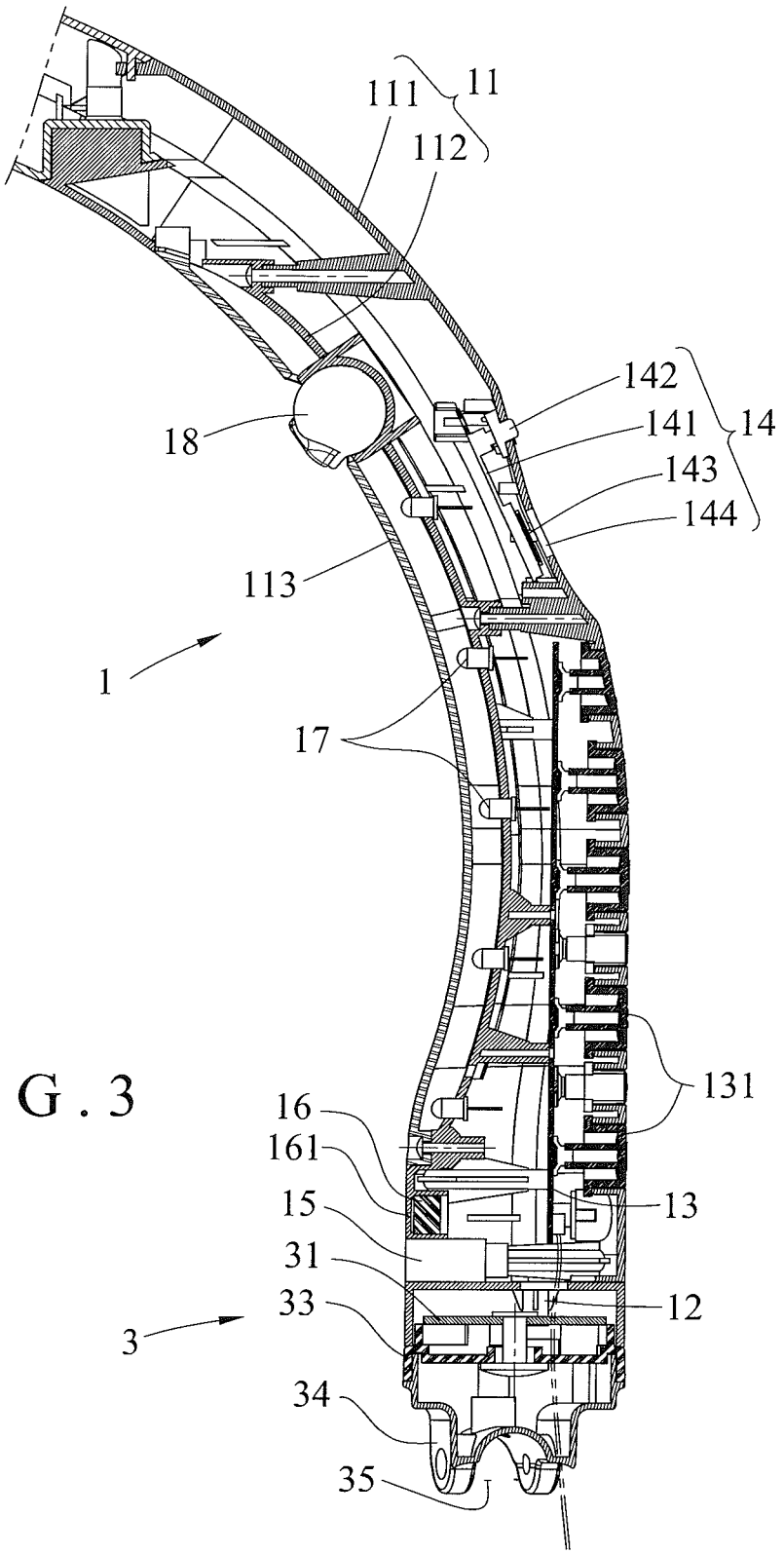
FIG. 3 is a locally enlarged view of the baby toy as shown in FIG. 2.
Figure 4:
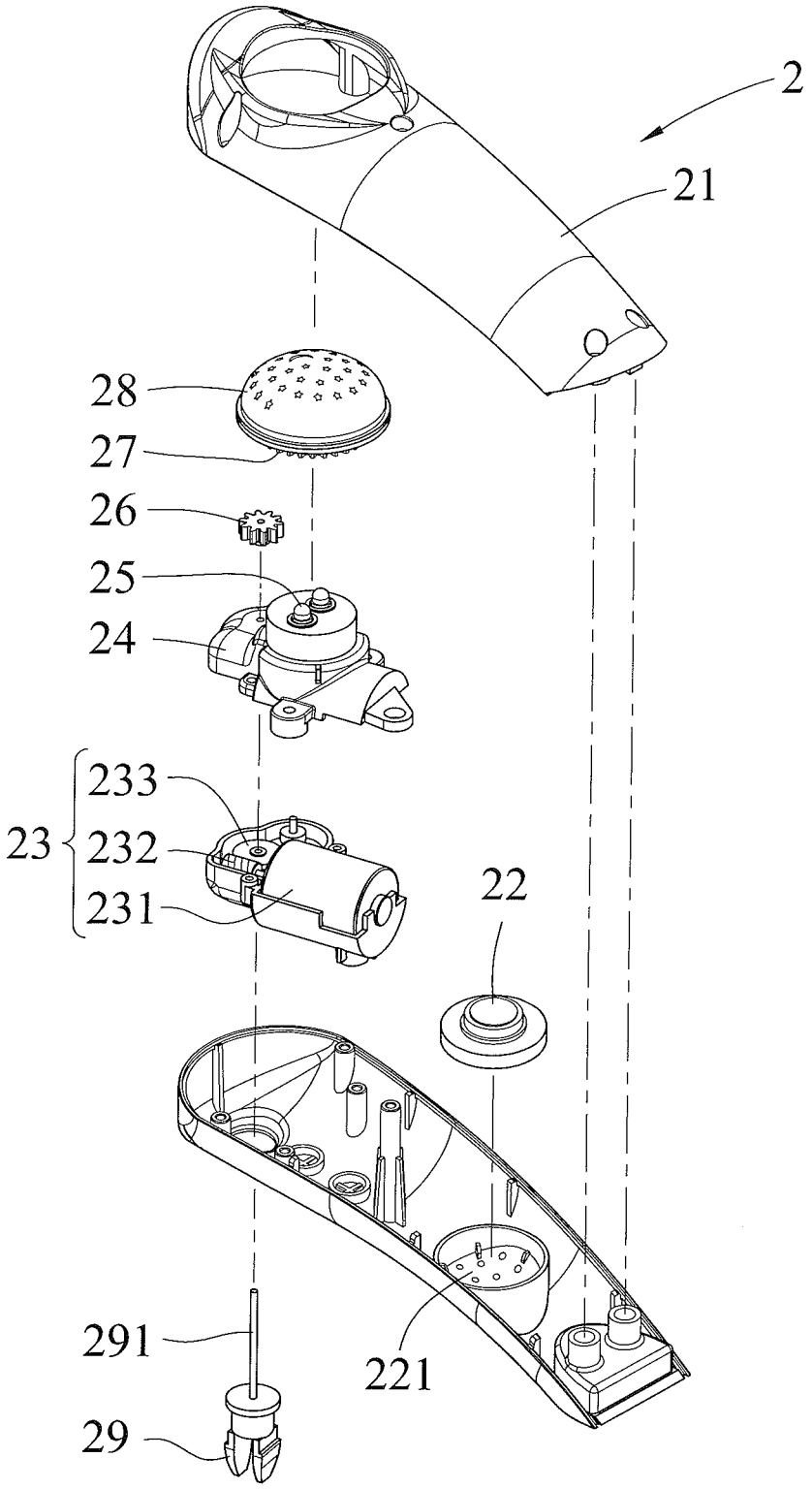
FIG. 4 is a partially exploded perspective view of the baby toy as shown in FIG. 1.
Figure 5:
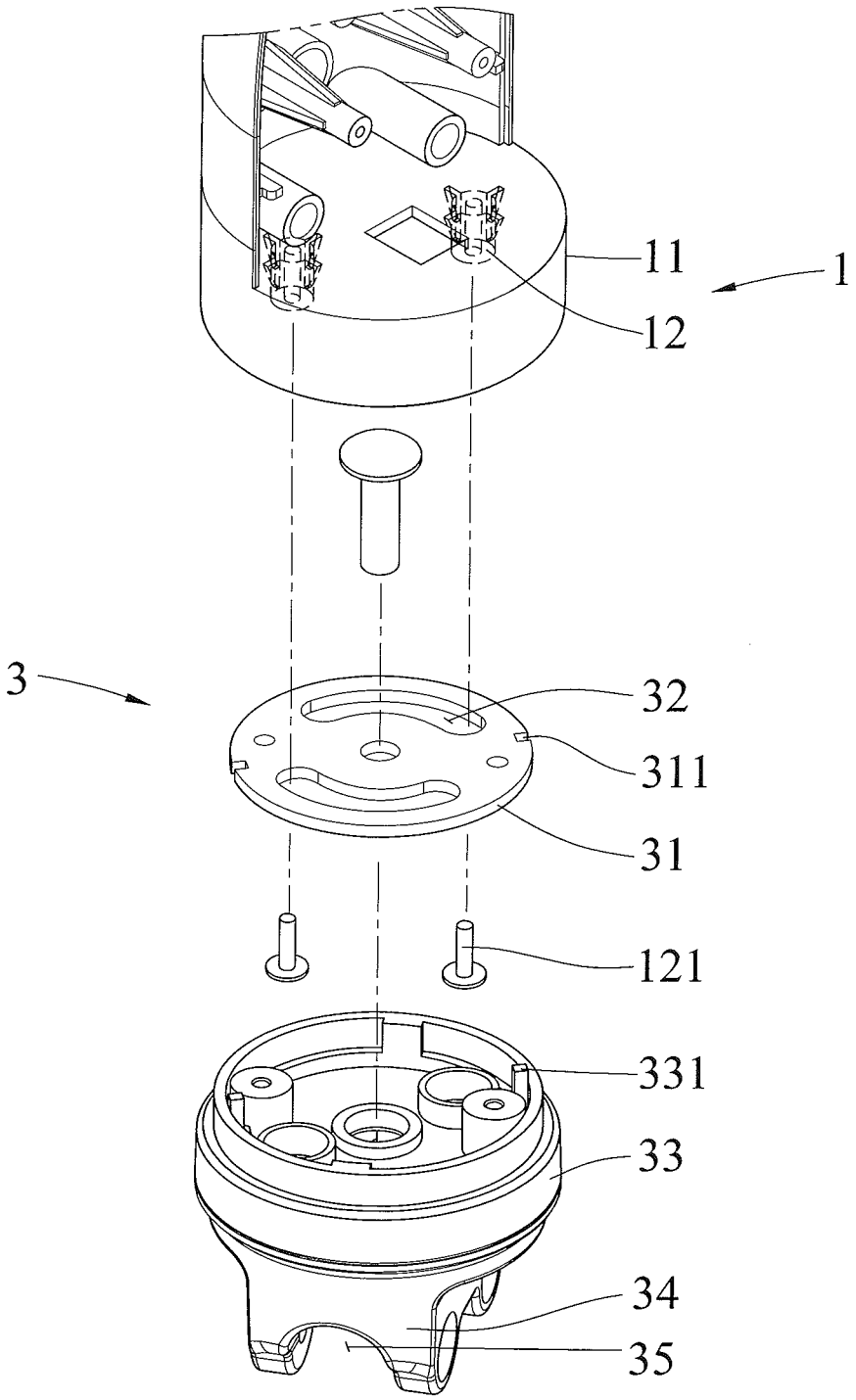
FIG. 5 is a partially exploded perspective view of the baby toy as shown in FIG. 1.

Alternatively, as shown in FIG. 2, the vibrator 19 is started and controlled by the operation buttons 131 of the circuit board 13 to provide a vibrating effect to the baby cot.

Figure 10:
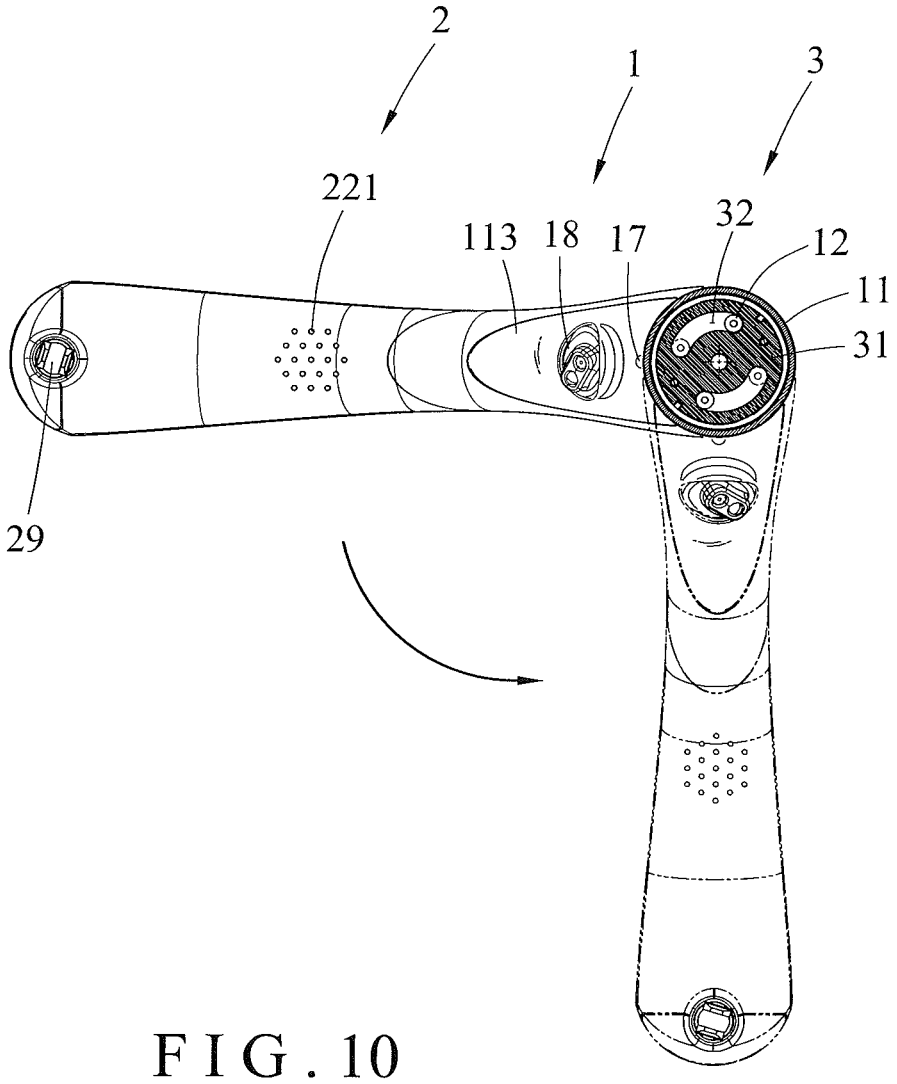
FIG. 10 is a bottom cross-sectional operational view of the baby toy as shown in FIG. 1.

Alternatively, referring to FIG. 10 with reference to FIGS. 1-6, the lower arm 11 is rotated freely relative to the base 33 to change the angle of the acousto-optical baby toy relative to the baby cot. At this time, the protruding columns 12 are limited in the arcuate slots 32 of the limit plate 31 to limit the rotation angle of the lower arm 11.

Figure 11:
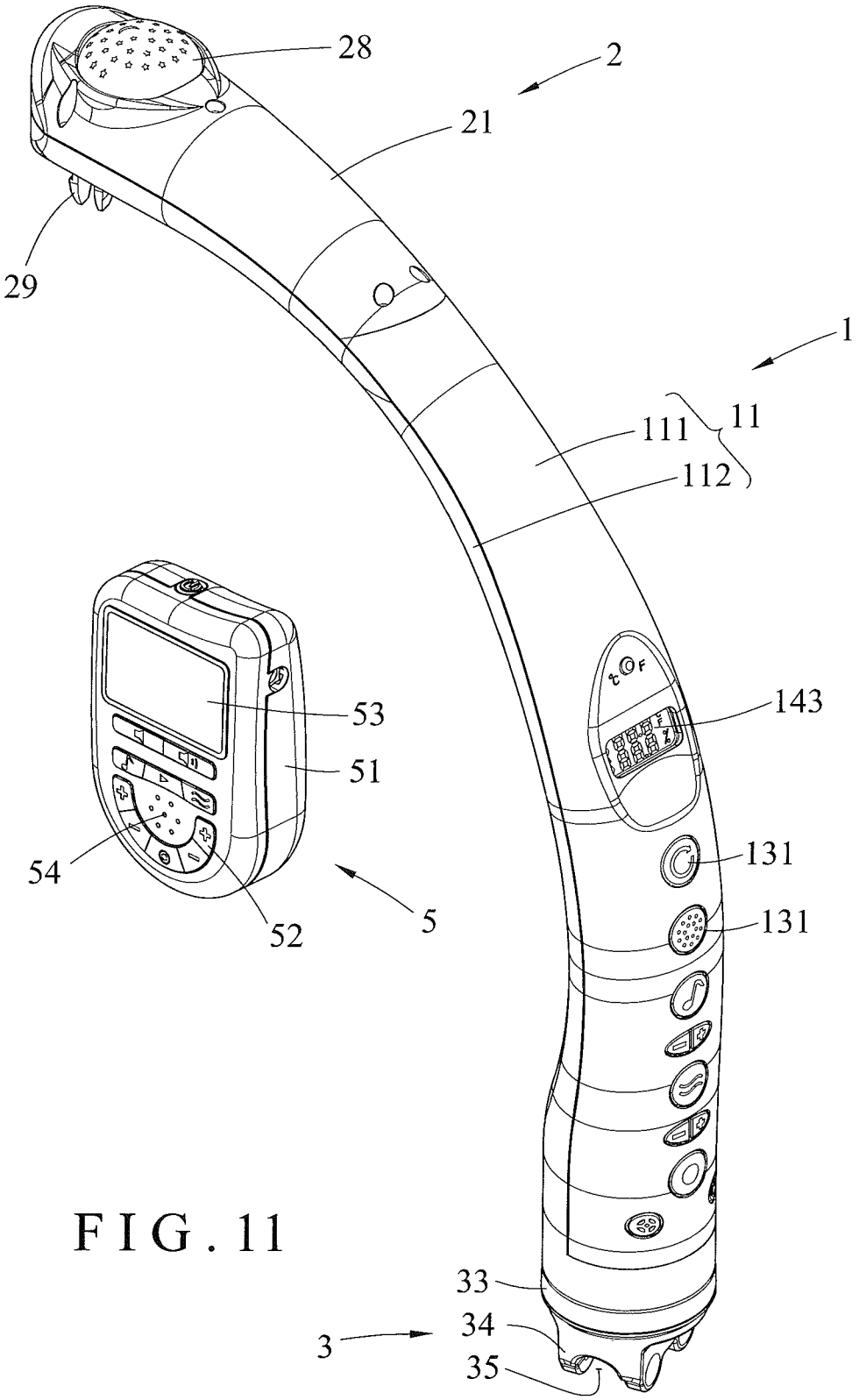
FIG. 11 is a perspective view of a baby toy in accordance with another preferred embodiment of the present invention.
Figure 12:
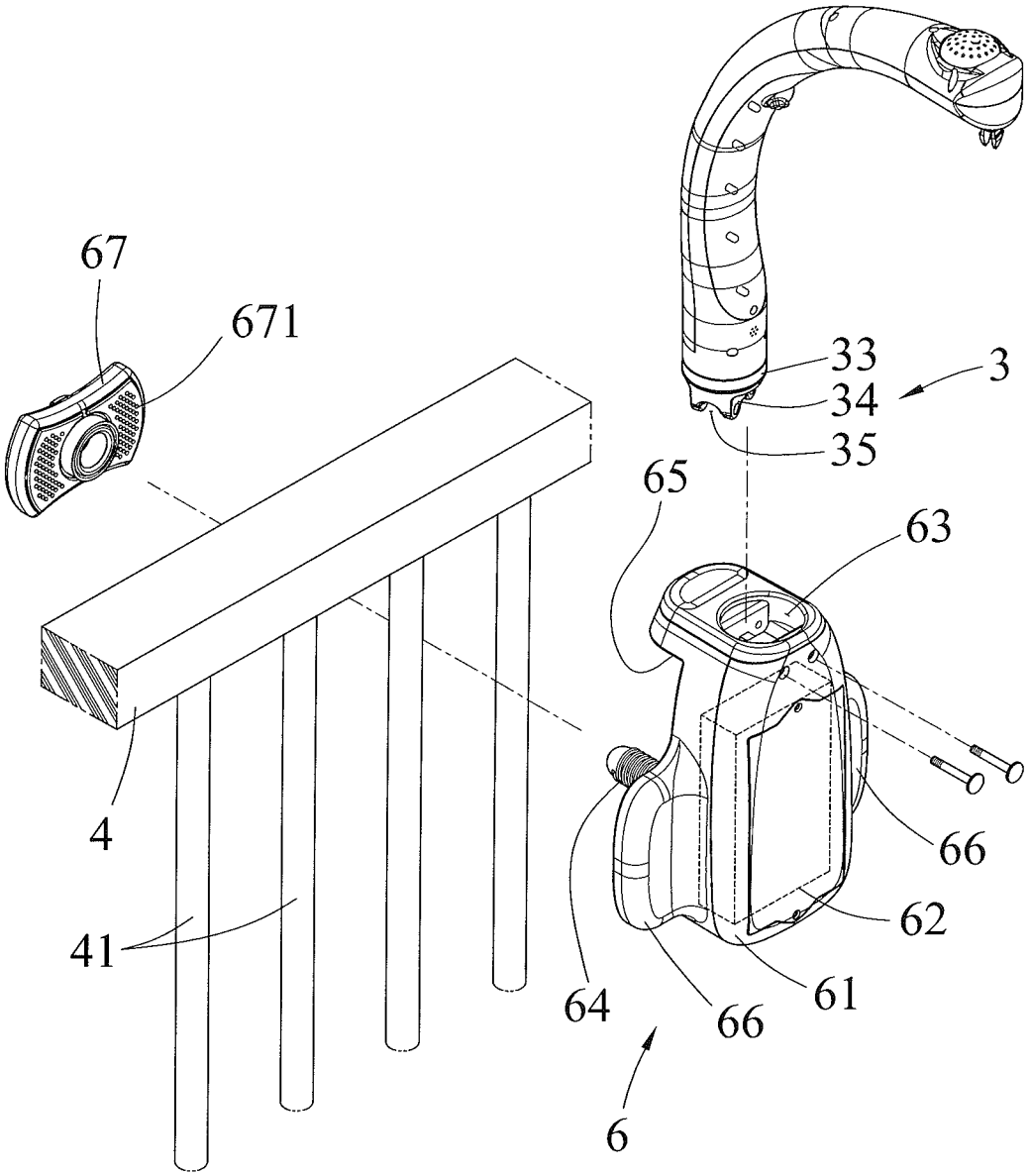
FIG. 12 is a partially exploded perspective view of a baby toy in accordance with another preferred embodiment of the present invention.
Figure 13:
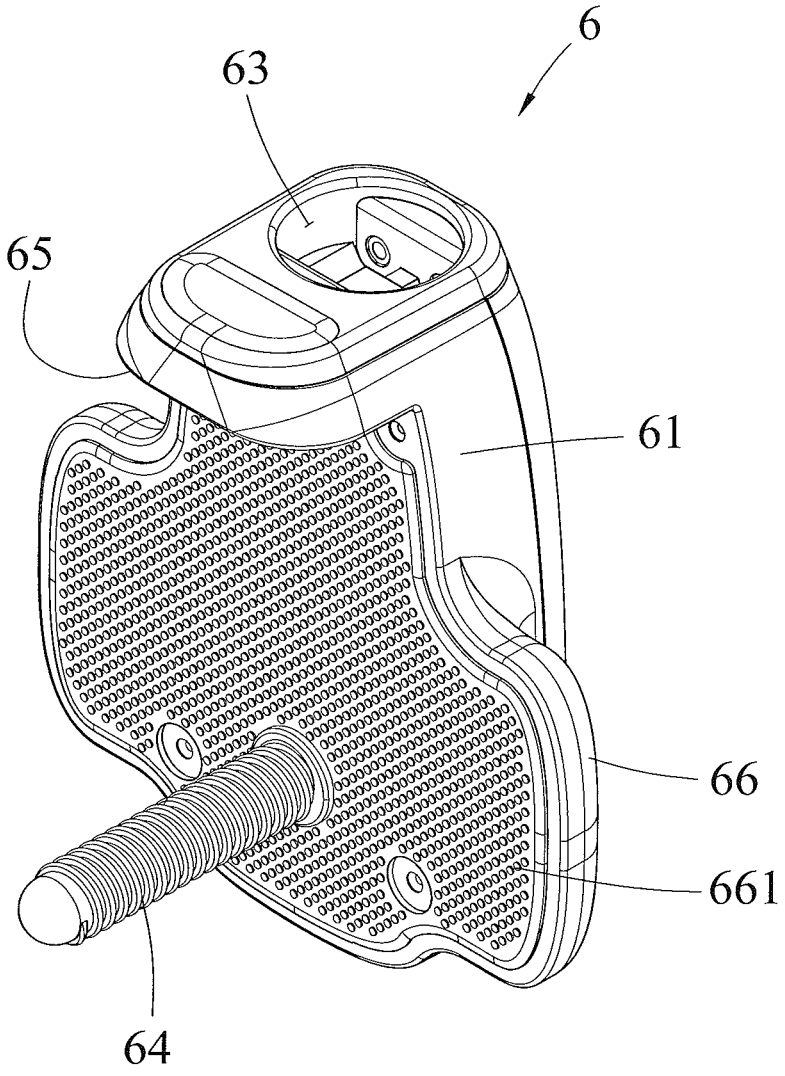
FIG. 13 is a perspective view of a connector of the baby toy as shown in FIG. 12.
Figure 14:
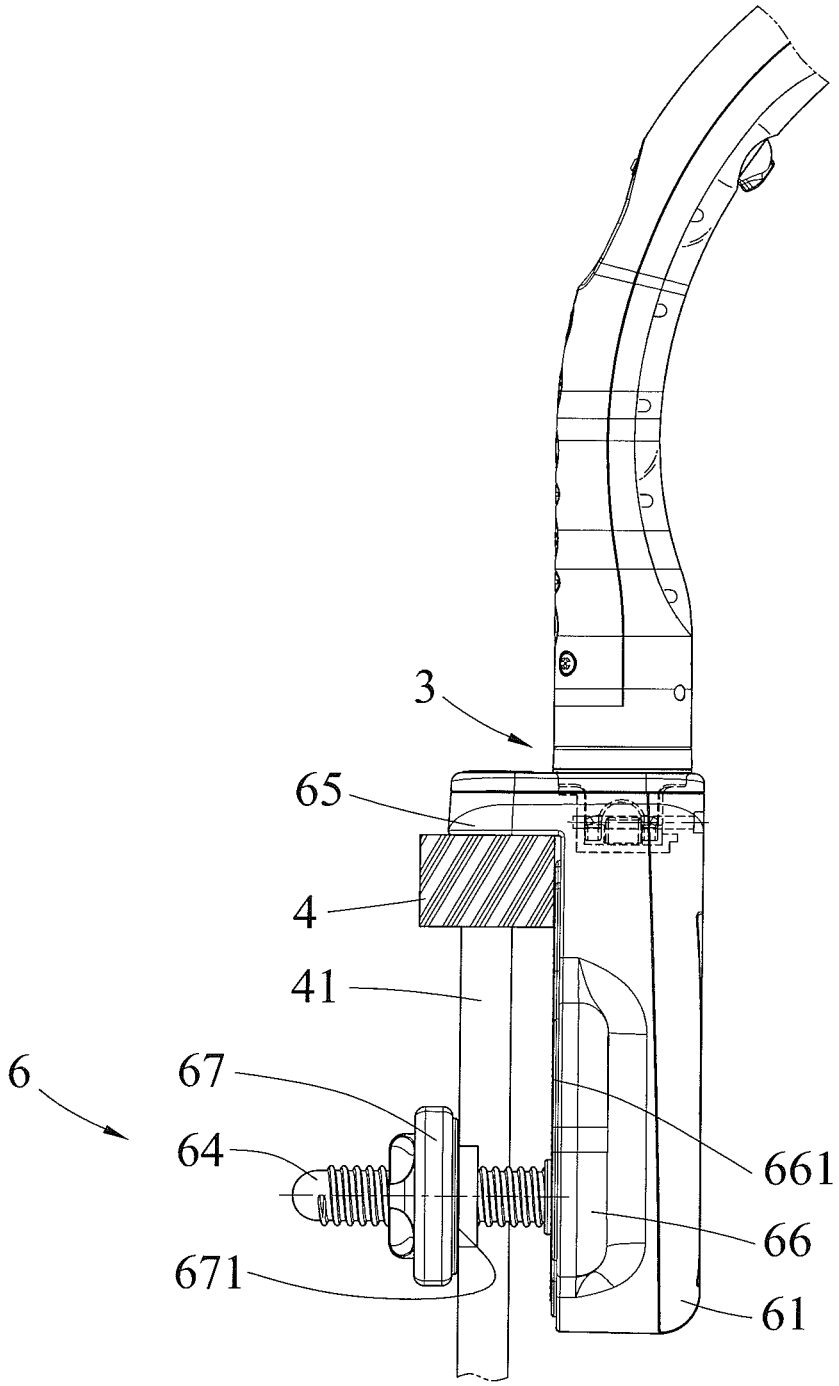
FIG. 14 is a cross-sectional assembly view of the baby toy as shown in FIG. 12.
Figure 15:
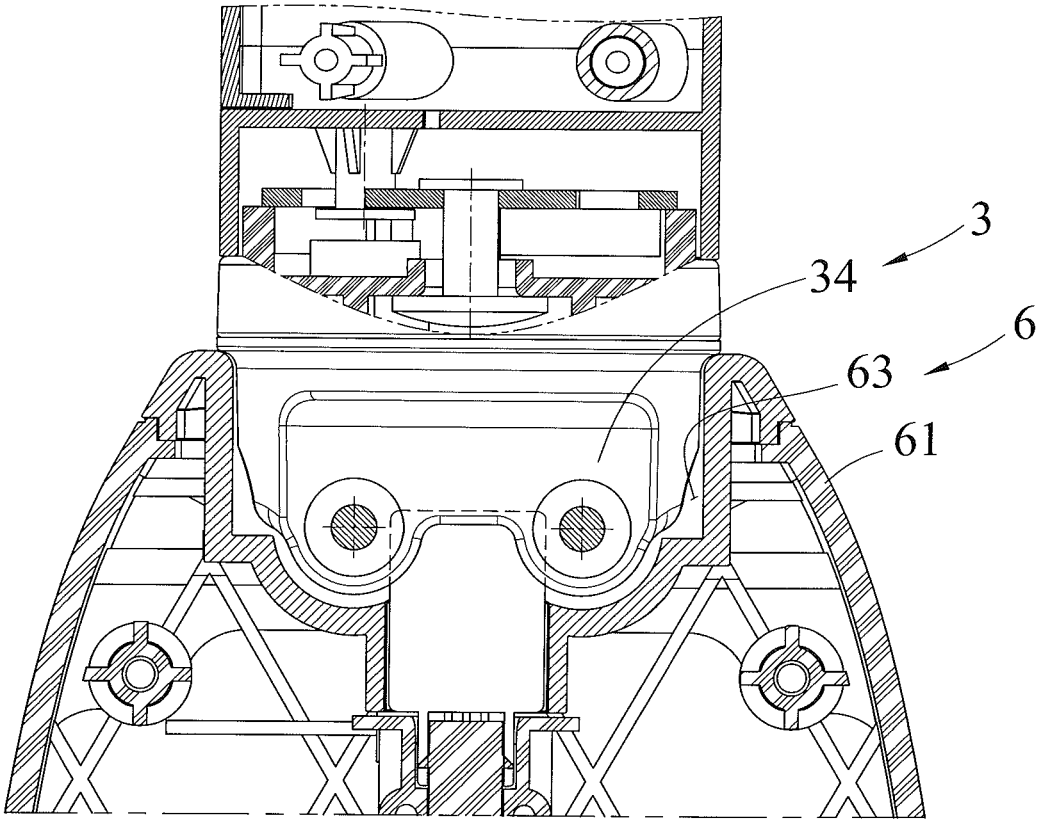
FIG. 15 is a locally cross-sectional assembly view of the baby toy as shown in FIG. 12.

Referring to FIG. 11 with reference to FIGS. 1-8, the acousto-optical baby toy further comprises a remote controller 5 connected with the circuit board 13 of the cantilever control unit 1 in a wireless manner. The remote controller 5 includes a controller body 51, a plurality of control buttons 52 mounted on the controller body 51 and having functions corresponding to that of the operation buttons 131 of the cantilever control unit 1, a monitor 53 mounted on the controller body 51, and a sound emitter 54 mounted on the controller body 51. In use, the user operates the control buttons 52 to control operation of the acousto-optical baby toy so that the acousto-optical baby toy is aided by the remote controller 5 to perform the related acoustic, optical and vibrating functions. In addition, the acoustic messages of the sound receiver 16 are transmitted to and played by the sound emitter 54 so that the remote controller 5 can receive and emit the acoustic messages of the baby cot. In addition, the image messages of the surveillance camera 18 are transmitted to and played by the monitor 53 so that the remote controller 5 can receive and play the image messages of the baby cot. Thus, the parents can operate the remote controller 5 to observe the condition of the baby seated in the baby cot. In addition, the sound of the parents is recorded by the sound emitter 54 and is then transmitted to and played by the speaker 22.

Referring to FIGS. 12-15 with reference to FIGS. 1 and 2, the acousto-optical baby toy further comprises a connector 6 connected with the support unit 3 and mounted on the fence 4 of the baby cot to attach the acousto-optical baby toy to the baby cot. The fence 4 includes a plurality of posts 41. The connector 6 includes a mounting block 61 having a top provided with a mounting recess 63 mounted on the connecting blocks 34 of the support unit 3, a power supply box 62 mounted in the mounting block 61, a threaded rod 64 mounted on a side of the mounting block 61, an upper hook 65 mounted on an upper end of the mounting block 61, two wing plates 66 mounted on the mounting block 61, and a threaded locking plate 67 screwed onto the threaded rod 64. A first antiskid face 661 is provided on the mounting block 61 and the wing plates 66. The connecting blocks 34 of the support unit 3 are mounted in the mounting recess 63 of the mounting block 61 and are locked by locking members. The locking plate 67 is provided with a second antiskid face 671. In assembly, the threaded rod 64 is inserted between two posts 41 of the fence 4, the wing plates 66 abut the two posts 41, and the upper hook 65 is hooked onto the top face of the fence 4. Then, the locking plate 67 is screwed onto the threaded rod 64 and abut the two posts 41 to sandwich the two posts 41 between the mounting block 61 and the locking plate 67, so that the connector 6 is mounted on the fence 4 to attach the acousto-optical baby toy to the baby cot. At this time, the first antiskid face 661 and the second antiskid face 671 increase the friction between the connector 6 and the fence 4, so that the connector 6 is mounted on the fence 4 tightly and closely. Thus, when the connecting blocks 34 of the support unit 3 are mounted in the mounting recess 63 of the mounting block 61, the power supply box 62 in the mounting block 61 to provide the required electric power of the acousto-optical baby toy.

Accordingly, the acousto-optical baby toy presents the sound and image messages of the baby cot in a wireless manner so that the parents can operate the acousto-optical baby toy in a remote control manner to watch the instant condition of the baby placed in the baby cot, thereby keeping the baby's safety. In addition, the acousto-optical baby toy indicates the environmental messages, functions as a night lamp, has an interactive acousto-optical effect and provides a vibrating function, thereby enhancing the versatility of the acousto-optical baby toy, and thereby facilitating the parents taking care of the baby in the baby cot.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A baby toy comprising:

a cantilever control unit;

an acousto-optical unit connected with the cantilever control unit; and a support unit connected with the cantilever control unit;

wherein:

the cantilever control unit includes:

a lower arm having a surface provided with an external connecting hole;

at least two protruding columns mounted on a bottom of the lower arm;

a circuit board mounted in the lower arm;

a plurality of operation buttons mounted on the lower arm and connected with the circuit board;

an environment detector mounted on the lower arm;

a sound receiver mounted in the lower arm;

a plurality of functional lamps mounted on the lower arm;

a side lamp shade mounted on the lower arm and corresponding to the functional lamps;

a surveillance camera mounted on the lower arm; and a vibrator externally connected with the circuit board;

the lower arm has a curved arcuate shape;

the side lamp shade is made of a light permeable material;

the acousto-optical unit includes:

an upper arm connected with an upper end of the lower arm of the cantilever control unit;

a speaker mounted in the upper arm;
a driver mounted in the upper arm;
a lamp holder mounted in the upper arm;
a plurality of projecting lamps mounted on the lamp holder;
a projecting shade mounted on the upper arm and covering the projecting lamps;
an outer annular gear mounted on the projecting shade;
a rotation gear mounted on the lamp holder and meshing with the outer annular gear; and
a hanging member having a connecting shaft extended through the upper arm and connected with the driver and the rotation gear;
the upper arm has a curved arcuate shape;
the rotation gear is driven by the driver;
the driver drives and rotates the rotation gear and the connecting shaft of the hanging member simultaneously;
the hanging member is used for hanging a toy;
the support unit includes:
a base located at the bottom of the lower arm;
a limit plate connected with the base;
two connecting blocks mounted on the base; and
a recessed portion formed between the connecting blocks;
the lower arm is rotatably mounted on and rotatable relative to the base;
the base is provided with at least two limit pieces;
the limit plate is provided with two arcuate slots;
the protruding columns are extended into the arcuate slots of the limit plate;
the limit plate has a periphery provided with at least two limit grooves mounted on the limit pieces of the base;
the recessed portion is mounted on a baby cot to attach the baby toy to the baby cot;
the circuit board is electrically connected with the external connecting hole, the sound receiver, the functional lamps, the surveillance camera, the speaker and the driver; and
a memory unit is built in the circuit board to store musical files for the speaker or image files for the surveillance camera.

2. The baby toy of claim 1, wherein:
the environment detector includes:
an environment detection plate mounted in the lower arm;
a switching button protruded outward from the lower arm and connected with the environment detection plate; and
an indication portion connected with the environment detection plate; and
the lower arm is formed with an exposing hole aligning with the indication portion to expose the indication portion.

3. The baby toy of claim 1, wherein the cantilever control unit further includes two fasteners connected with the protruding columns respectively and abutting a bottom of the limit plate to limit the protruding columns in the arcuate slots of the limit plate.

4. The baby toy of claim 1, wherein:
the driver includes:
a motor;
a drive gear connected with the motor; and
a driven gear meshing with the drive gear;
the connecting shaft is connected with the driven gear; and
the driven gear of the driver drives and rotates the rotation gear and the connecting shaft of the hanging member simultaneously.

5. The baby toy of claim 1, wherein:
the baby toy further comprises a connector connected with the support unit and mounted on a fence;
the connector includes:
a mounting block having a top provided with a mounting recess mounted on the connecting blocks of the support unit;
a power supply box mounted in the mounting block;
a threaded rod mounted on a side of the mounting block;
an upper hook mounted on an upper end of the mounting block;
two wing plates mounted on the mounting block; and
a threaded locking plate screwed onto the threaded rod.

6. A baby toy comprising:
a cantilever control unit;
an acousto-optical unit connected with the cantilever control unit; and
a support unit connected with the cantilever control unit;
wherein:
the cantilever control unit includes:
a lower arm having a surface provided with an external connecting hole;
at least two protruding columns mounted on a bottom of the lower arm;
a circuit board mounted in the lower arm;
a plurality of operation buttons mounted on the lower arm and connected with the circuit board;
an environment detector mounted on the lower arm;
a sound receiver mounted in the lower arm;
a plurality of functional lamps mounted on the lower arm;
a side lamp shade mounted on the lower arm and corresponding to the functional lamps;
a surveillance camera mounted on the lower arm; and
a vibrator externally connected with the circuit board;
the lower arm has a curved arcuate shape;
the side lamp shade is made of a light permeable material;
the acousto-optical unit includes:
an upper arm connected with an upper end of the lower arm of the cantilever control unit;
a speaker mounted in the upper arm;
a driver mounted in the upper arm;
a lamp holder mounted in the upper arm;
a plurality of projecting lamps mounted on the lamp holder;
a projecting shade mounted on the upper arm and corresponding to the projecting lamps;
an outer annular gear mounted on the projecting shade;
a rotation gear mounted on the lamp holder and meshing with the outer annular gear; and
a hanging member having a connecting shaft extended through the upper arm and connected with the driver and the rotation gear;
the upper arm has a curved arcuate shape;
the rotation gear is driven by the driver;
the driver drives and rotates the rotation gear and the connecting shaft of the hanging member simultaneously;
the hanging member is used for hanging a toy;
the support unit includes:
a base located at the bottom of the lower arm;
a limit plate connected with the base;
two connecting blocks mounted on the base; and
a recessed portion formed between the connecting blocks;
the lower arm is rotatably mounted on and rotatable relative to the base;
the base is provided with at least two limit pieces;
the limit plate is provided with two arcuate slots;

the protruding columns are extended into the arcuate slots of the limit plate;

the limit plate has a periphery provided with at least two limit grooves mounted on the limit pieces of the base;

the recessed portion is mounted on a baby cot to attach the baby toy to the baby cot;

the circuit board is electrically connected with the external connecting hole, the sound receiver, the functional lamps, the surveillance camera, the speaker and the driver;

a memory unit is built in the circuit board to store musical files for the speaker or image files for the surveillance camera;

the baby toy further comprises a remote controller connected with the circuit board of the cantilever control unit in a wireless manner;

the remote controller includes:

a controller body;

a plurality of control buttons mounted on the controller body and having functions corresponding to that of the operation buttons of the cantilever control unit;

a monitor mounted on the controller body; and a sound emitter mounted on the controller body.

7. The baby toy of claim 6, wherein:

the environment detector includes:

an environment detection plate mounted in the lower arm;

a switching button protruded outward from the lower arm and connected with the environment detection plate; and an indication portion connected with the environment detection plate; and the lower arm is formed with an exposing hole aligning with the indication portion to expose the indication portion.

8. The baby toy of claim 6, wherein the cantilever control unit further includes two fasteners connected with the protruding columns respectively and abutting a bottom of the limit plate to limit the protruding columns in the arcuate slots of the limit plate.

9. The baby toy of claim 6, wherein:

the driver includes:

a motor;

a drive gear connected with the motor; and a driven gear meshing with the drive gear;

the connecting shaft is connected with the driven gear; and the driven gear of the driver drives and rotates the rotation gear and the connecting shaft of the hanging member simultaneously.

10. The baby toy of claim 6, wherein:

the baby toy further comprises a connector connected with the support unit and mounted on a fence;

the connector includes:

a mounting block having a top provided with a mounting recess mounted on the connecting blocks of the support unit;

a power supply box mounted in the mounting block;

a threaded rod mounted on a side of the mounting block;

an upper hook mounted on an upper end of the mounting block;

two wing plates mounted on the mounting block; and a threaded locking plate screwed onto the threaded rod.

* * * * *